US010570878B2

(12) United States Patent
Diebold et al.

(10) Patent No.: US 10,570,878 B2
(45) Date of Patent: Feb. 25, 2020

(54) ADJUSTING DEVICE FOR A HYDRAULIC MACHINE, AND HYDRAULIC AXIAL PISTON MACHINE

(71) Applicant: Robert Bosch GmbH, Stuttgart (DE)

(72) Inventors: Carola Diebold, Eutingen (DE); Andreas Apperger, Eutingen (DE)

(73) Assignee: Robert Bosch GmbH, Stuttgart (DE)

( * ) Notice: Subject to any disclaimer, the term of this patent is extended or adjusted under 35 U.S.C. 154(b) by 1495 days.

(21) Appl. No.: 14/086,904

(22) Filed: Nov. 21, 2013

(65) Prior Publication Data

US 2014/0147298 A1 May 29, 2014

(30) Foreign Application Priority Data

Nov. 24, 2012 (DE) ..... 10 2012 022 997

(51) Int. Cl.

| | |
|---|---|
| ***F04B 1/29*** | (2006.01) |
| ***F03C 1/06*** | (2006.01) |
| ***F03C 1/40*** | (2006.01) |
| ***F04B 1/324*** | (2020.01) |
| ***F04B 1/2078*** | (2020.01) |

(52) U.S. Cl.

CPC ..... *F03C 1/0668* (2013.01); *F03C 1/0686* (2013.01); *F04B 1/2078* (2013.01); *F04B 1/324* (2013.01); *Y10T 137/8593* (2015.04)

(58) Field of Classification Search

CPC ..... F04B 1/26; F04B 1/28; F04B 1/29; F04B 1/295; F04B 49/002; F04B 1/324; F04B 1/2078; F04B 49/08; F03C 1/0668; F03C 1/0686; Y10T 137/8593

USPC ..... 417/222.1, 216, 212; 92/12.1

See application file for complete search history.

(56) References Cited

U.S. PATENT DOCUMENTS

| | | | | |
|---|---|---|---|---|
| 4,379,389 A | 4/1983 | Liesener | | |
| 6,684,636 B2 * | 2/2004 | Smith | F04B 1/295 | 417/212 |
| 6,725,658 B1 * | 4/2004 | Lemmen | F04B 1/324 | 60/443 |
| 7,334,513 B2 * | 2/2008 | Belser | F04B 1/324 | 92/12.1 |

FOREIGN PATENT DOCUMENTS

| | | |
|---|---|---|
| DE | 40 20 325 A1 | 1/1992 |
| DE | 100 01 826 C1 | 9/2001 |

* cited by examiner

*Primary Examiner* — Dominick L Plakkoottam
*Assistant Examiner* — Connor J Tremarche
(74) *Attorney, Agent, or Firm* — Maginot, Moore & Beck LLP

(57) ABSTRACT

An adjusting device for an axial piston machine includes an actuating piston that delimits an actuating space configured to be connected to a control oil source or a control oil drain via a control valve. A control piston of the control valve is loaded firstly by a control spring and secondly by a spring arrangement that is also in active engagement with the actuating piston.

20 Claims, 3 Drawing Sheets

ADJUSTING DEVICE FOR A HYDRAULIC MACHINE, AND HYDRAULIC AXIAL PISTON MACHINE

This application claims priority under 35 U.S.C. § 119 to patent application no. DE 10 2012 022 997.6 filed on Nov. 24, 2012 in Germany, the disclosure of which is incorporated herein by reference in its entirety.

BACKGROUND

The disclosure relates to an adjusting device which is provided for a hydraulic machine, in particular for a hydraulic axial piston machine, and to a hydraulic axial piston machine, in particular for an axial piston pump, which is configured with an adjusting device of this type.

An axial piston machine of this type is known, for example, from DE 100 01 826 C1. Said axial piston machine which is configured as an axial piston pump has a driving mechanism with a multiplicity of axial pistons which are guided within a cylinder barrel and, together with the latter, in each case delimit a working space. End sections of the pistons on the piston bottom side are supported via sliding pads on a pivot cradle, the pivoting angle of which can be adjusted in order to set the delivery/displacement volume. This adjustment takes place via an adjusting device, an actuating piston acting indirectly or directly on the pivot cradle and pivoting the latter out of a basic position, into which the pivot cradle is prestressed via an opposing cylinder or a spring. In said basic position, the pivot cradle can be set, for example, to its maximum pivoting angle, the pivot cradle then pivoting back by way of extension of the actuating piston. The basic setting to the maximum pivoting angle is advantageous, since, during starting up of the pump, it can immediately deliver a large pressure medium volumetric flow.

In the known solution, the adjusting device for adjusting the pivot cradle is configured as what is known as a power regulator, via which the product of the pressure at the outlet of the pump and the displacement volume is to be kept approximately constant. Strictly speaking, this is a regulation of moment. Power regulation can actually only be spoken of here if the rotational speed is constant.

The actuating piston delimits an actuating space which can be connected via a control valve (what is known as a power regulator) to a line which conducts the pump pressure or to the tank. Said control valve has a control piston which is prestressed via a spring arrangement into a basic position, in which the actuating space is connected to the tank and the actuating piston is therefore retracted. Said spring arrangement is supported on a spring rod which penetrates the control piston and is connected to the actuating piston which is therefore arranged coaxially with respect to the control piston. A differential face is configured on the control piston, which differential face is loaded with the pump pressure, with the result that the control piston can be adjusted counter to the force of the control springs by way of the pump pressure.

In the known solution, the spring arrangement has two springs which are arranged coaxially with respect to one another and of which one comes into engagement only after a certain stroke of the actuating piston, with the result that a p-Q characteristic curve (pressure-delivery flow characteristic curve) is set which consists of two straight lines, the gradient of one straight line being defined by the spring constant of the spring which is first of all in engagement and the gradient of the further straight line being defined by the spring rates of the springs which are jointly in engagement after the part stroke. The optimum hyperbolic p-Q characteristic curve is approximated by way of these two straight lines which are set against one another.

A disadvantage of the known solution is that the adjusting device is of very complex construction on account of the spring rod which penetrates the control piston and, in addition, has a considerable overall length.

DE 40 20 325 C2 discloses a solution, in which a pressure limiting regulator is also assigned to a moment or power regulator of this type.

U.S. Pat. No. 4,379,389 also discloses a solution having two springs, via which the hyperbolic characteristic curve is to be approximated.

In contrast, the disclosure is based on the object of providing an adjusting device and an axial piston machine which is configured with an adjusting device of this type, in which the power/moment regulation is made possible with reduced outlay in terms of device technology.

SUMMARY

This object is achieved with regard to an adjusting device having the features of the disclosure and with regard to an axial piston machine having the features of the disclosure.

Advantageous developments of the disclosure are the subject of the subclaims.

According to the disclosure, the adjusting device has an actuating piston which delimits an actuating space which can be connected to a control oil source (outlet of the pump) or a control oil drain (tank) via a control valve. The control valve has a control piston which can be adjusted out of a basic position counter to the force of at least one control spring. The control piston is configured with a differential face which is loaded by the system pressure and is formed by two sections of the control piston with different diameters, and said control piston is arranged approximately coaxially with respect to the actuating piston. The control piston is loaded in the opposite direction by a spring arrangement having at least one spring, in particular having at least two springs which are supported on the actuating piston. By way of the spring arrangement, the position of the actuating piston is fed back to the control piston as a force. If the spring arrangement has a plurality of springs, they are configured in such a way that, in the case of a control oil connection of the actuating space to the control oil source in order to adjust the actuating piston out of the basic position, one of the springs of the spring arrangement passes out of active engagement with the control piston or the actuating piston after a part stroke of the actuating piston.

Accordingly, after the part stroke, the spring force which is applied to the control piston by the spring arrangement is reduced, with the result that a characteristic curve is set, as is realized in the prior art. In contrast to the abovementioned prior art according to DE 100 01 826 C1, however, the spring arrangement in the solution according to the disclosure acts in the actuating direction of the actuating piston (out of the basic position), whereas, in the cited prior art, the two springs which are in active engagement in sections load the actuating piston in the direction of the basic position. The essential advantage of the solution according to the disclosure consists in the fact that the piston rod can be omitted, with the result that the adjusting device can be realized with low outlay in terms of device technology and a smaller overall length. If there is only one spring in the spring arrangement, it is preferably permanently in active engagement with the actuating piston and the control piston.

According to the disclosure, it is preferred if the control piston is configured with a differential face, upon the pressure loading of which a force is generated on the control piston, which force has the same direction as the force which is exerted by the spring arrangement.

According to one development of the disclosure, the control spring is configured with a greater spring rate/prestress than the spring arrangement, with the result that the control piston is prestressed into its basic position by way of the excess of force of the control spring.

Said control spring can be supported on a spring collar. The prestress of the control spring can be adjustable in order to shift the characteristic curve (dual torque).

This shift of the characteristic curve is particularly simple if the control spring is assigned an actuating spring, the prestress of which is adjustable and which actuating spring is preferably arranged coaxially with respect to the control spring.

The adjustment can be simplified further if said actuating spring has a considerably lower spring rate or prestress than the control spring, with the result that the shift of the characteristic curve takes place by adjustment of the prestress of the comparatively weak actuating spring.

This adjustment can take place, for example, hydraulically or electromagnetically. In the latter case, a considerably smaller magnet can be used than in the case in which the strong opposing spring is adjusted which is loaded with a comparatively high prestress.

In an exemplary embodiment of this type, the adjustment of the actuating spring takes place by means of a tappet which penetrates the spring collar of the control spring and on which the actuating spring is supported.

The adjusting device according to the disclosure can be used particularly advantageously in an axial piston machine, preferably an axial piston pump, the pivot cradle of which is prestressed into a basic position via a device, for example a spring or an opposing cylinder.

BRIEF DESCRIPTION OF THE DRAWINGS

Preferred exemplary embodiments of the disclosure will be explained in greater detail in the following text using diagrammatic drawings, in which.

DETAILED DESCRIPTION

Figure 1:
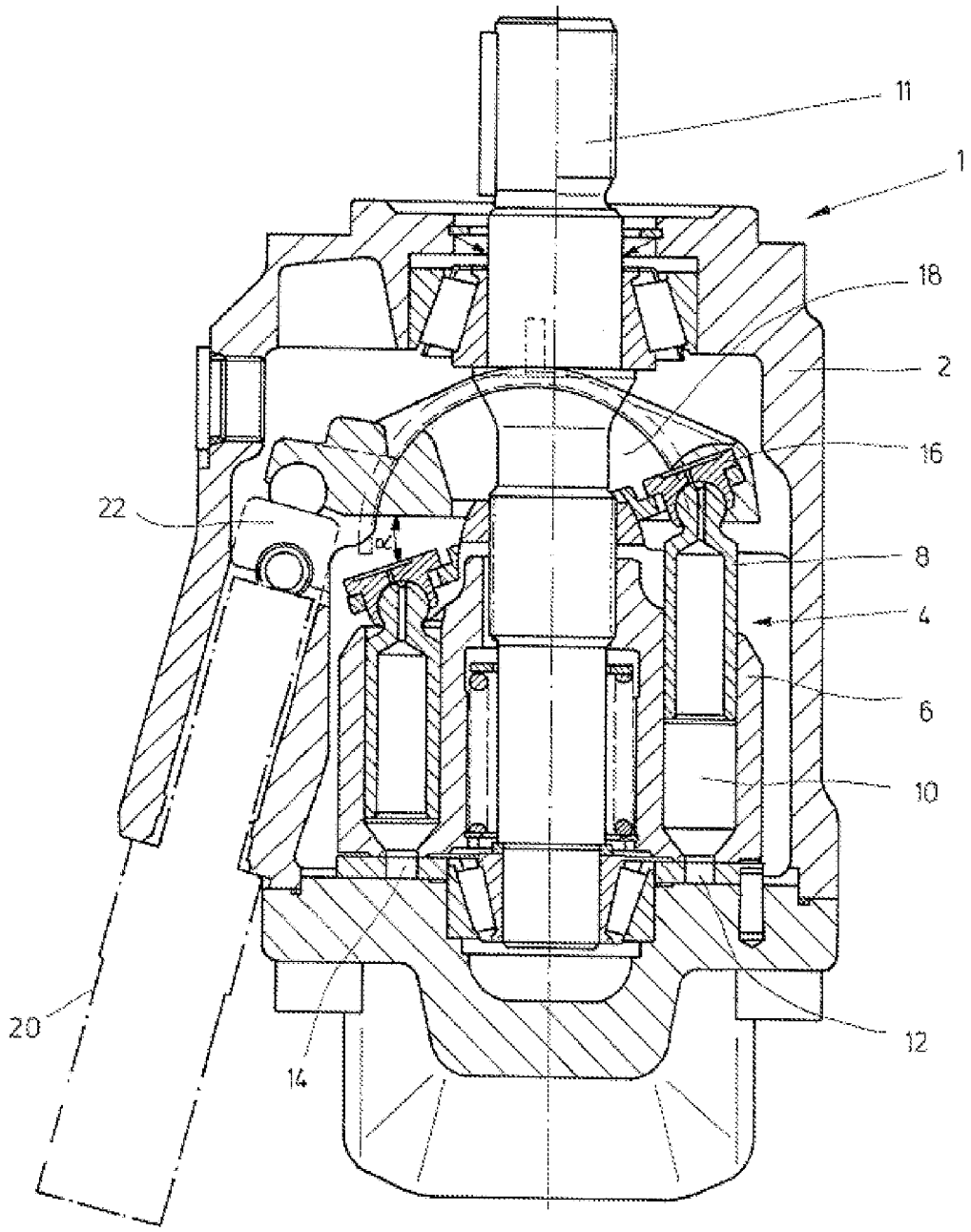
FIG. 1 shows a greatly simplified section through an axial piston machine according to the disclosure.

In the exemplary embodiments which are described in the following text, the axial piston machine is configured as an axial piston pump 1, the basic construction of which is shown in the section according to FIG. 1. The construction of axial piston pumps 1 of this type is sufficiently well known, for example, from DE 100 01 826 C1 which was cited at the outset, with the result that only the components which are essential to understanding the disclosure will be explained here. Accordingly, the axial piston pump 1 has a pump housing 2, in which a driving mechanism 4 is mounted. The latter has a cylinder barrel 6, in which a multiplicity of axial pistons 8 are guided which in each case delimit a working space 10. The pressure medium supply and pressure medium discharge to and from the working spaces 10 is controlled via control kidneys 12, 14 which are in pressure medium connection with a pressure connector and a suction connector of the pump. The cylinder barrel 6 is driven via a drive shaft 11 which is connected to a motor.

Those end sections of the axial pistons 8 which are remote from the working spaces 10 are supported via sliding pads 16 on a pivot cradle 18, the pivoting angle $\alpha$ of which can be adjusted in order to change the delivery volume by means of an adjusting device 20 which is indicated using dash-dotted lines. In the exemplary embodiment which is shown, the pivot cradle 18 is prestressed via a spring (not shown) into a basic position, in which the pivoting angle and therefore the delivery volume are at their maximum. By way of extension of an actuating piston (which will be explained in greater detail in the following text) of the adjusting device 20, the pivot cradle can be pivoted back counter to the force of said spring and the driving mechanism forces in order to reduce the pivoting angle and therefore the delivery volumetric flow. The attachment of the adjusting device 20 to the pivot cradle 18 takes place as shown, for example, via a type of ball and slip joint device 22.

Figure 2:
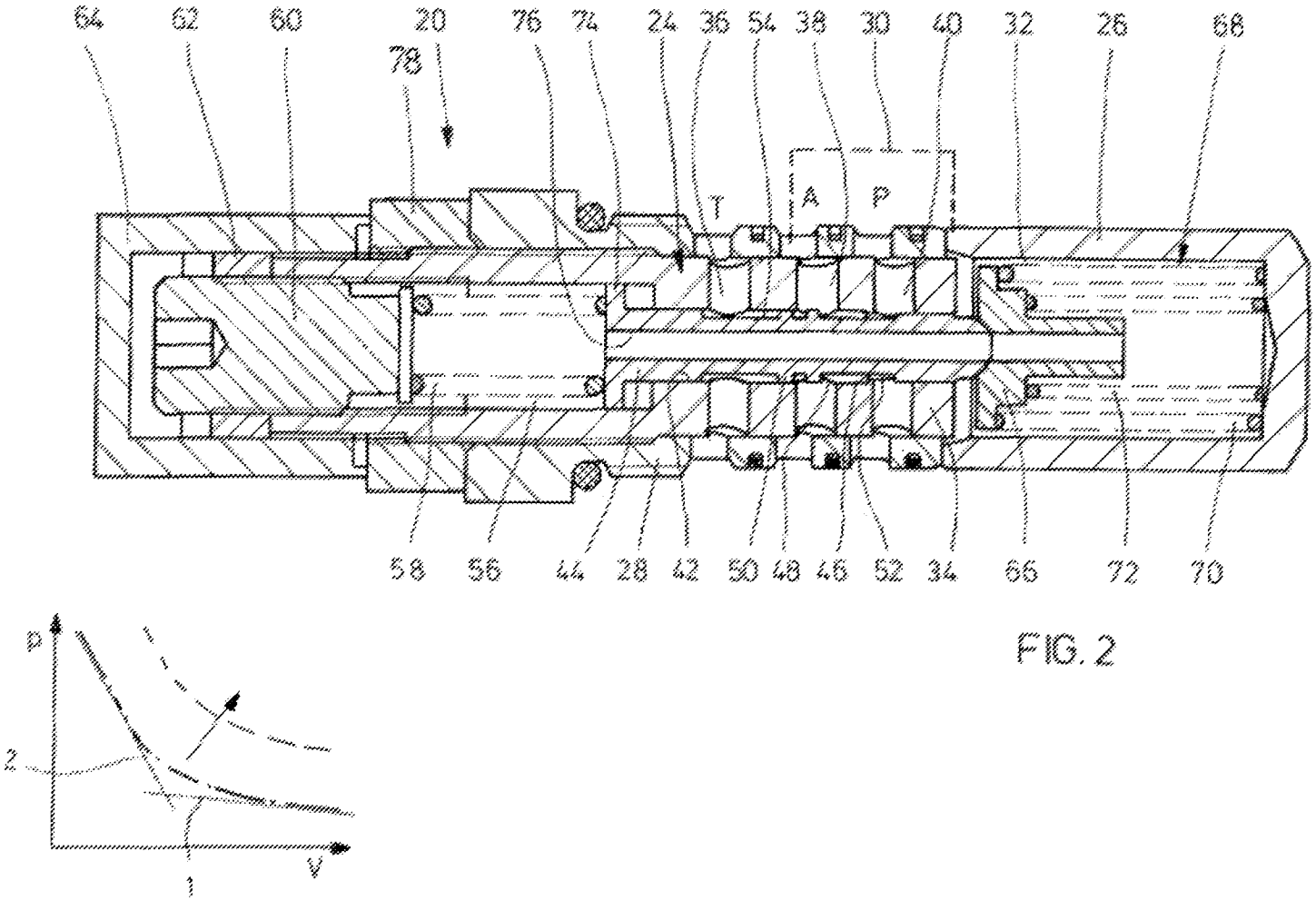
FIG. 2 shows a longitudinal section through an adjusting device of the axial piston machine according to FIG. 1.

FIG. 2 shows an exemplary embodiment of an adjusting device 20 in longitudinal section. An adjusting device of this type has substantially a control valve 24, via which an actuating piston 26 can be adjusted in order to adjust the pivot cradle 18. The adjusting device 20 is configured as power/moment regulator and has a valve bushing 28 which is inserted into a receptacle of the housing 2. The valve bushing 28 has, radially, a pressure connector P, a control connector A and a tank connector T. The pressure connector P is in pressure medium connection with the pressure connector of the axial piston pump 1. The tank connector T is in pressure medium connection with a tank or a suction connector of the axial piston pump 1. The control connector A is connected via a housing-side control oil flow path 30 (only shown using dashed lines) to an actuating space 32 which is delimited by the actuating piston 26 and a cylinder or guide bore of the housing 2. Here, the control oil connection to the actuating space 32 can take place, for example, via end-side grooves of the cup-shaped actuating piston 26; said grooves are not visible in FIG. 2. As an alternative, the control oil can be guided via bores in the sleeve 34 into the actuating chamber, the bores preferably lying in an axial plane which lies perpendicularly on the sectional plane according to FIG. 2.

A sleeve 34 is screwed into the valve bushing 28, which sleeve 34 is provided with radial bores 36, 38, 40 which are firstly in control oil connection with the abovementioned connectors P, A and T and secondly open into a valve bore 42, in which a control piston 44 of the control valve 24 is guided. The valve bore 42 is configured with a radial step 46, with the result that the control piston 44 is correspondingly also configured as a stepped piston and therefore has a differential face which is provided with the reference numeral 48 in the illustration according to FIG. 2 and is configured on a control collar 50. Two control grooves 52, 54 are formed on the outer circumference of the control piston 44, the function of which control grooves 52, 54 will be explained in yet further detail in the following text.

The left-hand end section in FIG. 2 of the control piston 44 dips into a spring space 56 which is formed by a radial widened portion of the valve bore 42. That end section of the control piston 44 which lies there is provided with a radial collar 74, on which a control spring 58 acts. The latter is supported on a threaded bolt 60 which is screwed into the sleeve 34 and via which the prestress of the control spring 58 can be set. After adjusting of said prestress, the position of the threaded bolt 60 is fixed via a lock nut 62. A covering 64 then forms the end-side closure, which covering 64 covers the threaded bolt 60 and the lock nut 62 and is placed onto the left-hand end section of the sleeve 34. The sleeve 34 is likewise of displaceable configuration via a thread and two flattened portions which serve as a key face. By way of displacement of the sleeve, the control edges of the control piston are displaced and therefore the point of engagement of the second spring 72 is adapted. The position of the sleeve 34 is fixed by way of the lock nut 78.

That end section of the control piston 44 which is remote from the control spring 58 dips into the actuating space 32. A stepped spring collar 66 is placed onto said end section, on which spring collar 66 a return spring arrangement 68 is supported with an outer spring 70 and an inner spring 72 which are arranged coaxially with respect to one another and act on a head of the cup-shaped actuating piston 26. Said actuating piston 26 is prestressed in end-side contact against the valve bushing 28 by way of the spring which is mentioned at the outset and prestresses the pivot cradle 18 into the basic position, the grooves for the control oil connection of the actuating space 32 to the control oil flow path 30 running along said end-side bearing region. By way of the return spring arrangement, the position of the pivot cradle is fed back to the control piston 44 as a force.

The spring rate and prestress of the spring arrangement 68 are selected to be lower than those of the control spring 58, with the result that the control piston 44 is prestressed with its radial collar 74 in contact with the end face of the spring space 56; this basic position is not shown in FIG. 2.

In the basic position, the control groove 52 shuts off the control oil connection between the pressure connector P and the control connector A, whereas the control oil connection between the control connector A and the tank connector T is opened via the further control groove 54. Accordingly, the actuating space 32 is connected to the tank. However, the pressure at the pressure connector P acts on the differential face 48. Accordingly, the control piston 44 is loaded in the direction of the basic position (control oil connection between A and T) by the control spring 58 and in the opposed direction (opening of the connection between A and P) by the spring arrangement 68 and the pump pressure which acts on the differential face 48. FIG. 2 shows a type of working position, in which the control piston 44 is displaced counter to the force of the control spring 58 by way of the pump pressure which acts on the differential face 48, with the result that the pressure medium connection from A to T is closed and the pressure medium connection from P to A is opened.

The control piston 44 and also the spring collar 66 are configured with an axial bore 76, by way of which the two spaces 56 and 68 are connected to one another, with the result that the control piston 44 is loaded on the end side (apart from the differential face 48, on which the pressure at the connector P acts) with the same pressure, that is to say with the actuating pressure.

During pressure medium supply of a consumer, the axial piston pump 1 is first of all pivoted out completely (see FIG. 1). The pressure at the connector P rises until the pressure which acts on the differential face 48 and the force of the spring arrangement 68 are sufficient to overcome the opposing force which is applied by the control spring 58, with the result that the control piston 44 is then moved out of its basic position to the left (view in FIG. 2) and the pressure medium connection between A and T is closed and correspondingly the pressure medium connection from P to A is opened (see FIG. 2). Accordingly, the actuating space 32 is then connected to the control oil source, that is to say a line section which conducts the pump pressure, with the result that the actuating piston 26 is moved counter to the force of the spring force which loads the pivot cradle 18 into its basic position and the driving mechanism force and pivots back the pivot cradle 18. The force of the spring arrangement decreases as a result, until a position is reached, in which a force equilibrium again prevails at the control piston 44. The control piston then assumes a control position, in which it covers the radial bore 38 with the control collar 50. By way of small movements out of the control position, control oil is fed to the actuating chamber or discharged from the actuating chamber, in order to maintain the position of the pivot cradle at the prevailing pump pressure. Since the spring arrangement 68 loads both the actuating piston 26 and the control piston 44, the movement of the pivot cradle 18 is coupled back to the control valve 24. At the beginning of the return pivoting movement, the power regulator operates approximately according to a characteristic curve which is identified by the straight line "1" in the diagram inserted in FIG. 2 at the bottom left.

After a defined part stroke of the actuating piston 26, the spring 72 of the springs of the spring arrangement 68, for example the spring 72 which lies on the inside, is relieved completely or passes out of active engagement with the actuating piston 26 with a certain residual prestress. The force which acts counter to the control spring 58 and is composed of the force of the spring arrangement 68 and the force which results from loading the differential face 48 with pressure is then reduced correspondingly, which results in a steeper course of the characteristic curve, which steeper course is identified by the straight line "2". The two straight lines "1" and "2" therefore result in a resulting characteristic curve which corresponds approximately to the hyperbolic ideal characteristic curve which is shown in the diagram using dash-dotted lines.

The position of the hyperbola or the straight lines "1" and "2" which approximate it can be changed by setting the prestress of the control spring 58.

Figure 3:
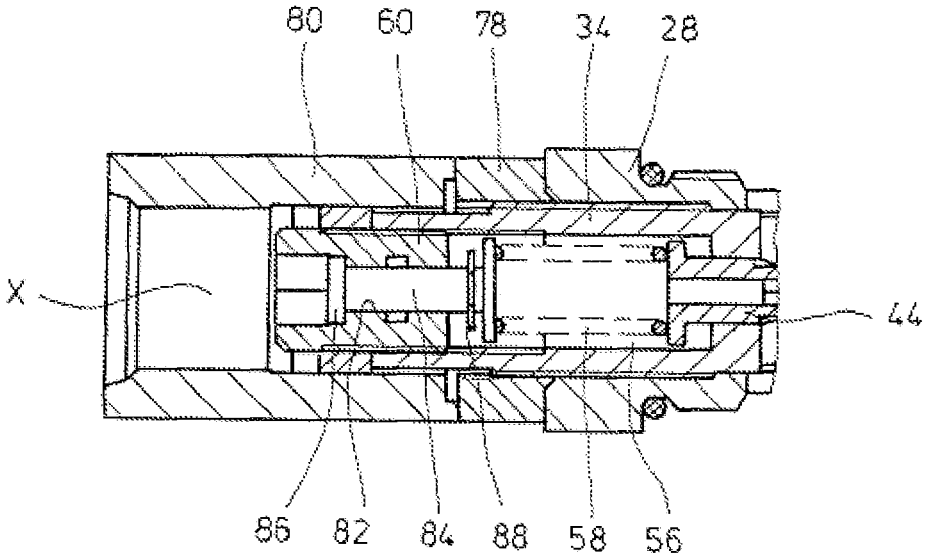
FIG. 3 shows a second exemplary embodiment of an adjusting device for an axial piston machine according to FIG. 1.

FIG. 3 shows a variant of the exemplary embodiment according to FIG. 2 which differs from the above-described exemplary embodiment only in the way in which the prestress of the control spring 58 is set. The construction of the control piston 44 and the spring arrangement 68 and the actuating piston 26 is identical to in the above-described exemplary embodiment, with the result that FIG. 3 shows merely the region which is important for the adjustment of the prestress of the control spring 58.

As in the above-described exemplary embodiment, the sleeve 34 is screwed into the valve bushing 28 and is locked via a lock nut 78. The control spring 58 acts on the control piston 44 and is arranged in the spring space 56, in which the actuating pressure is also active. Instead of the covering 64 in the exemplary embodiment according to FIG. 2, an adapter piece 80 is screwed onto the sleeve 34 in the exemplary embodiment according to FIG. 3, on which adapter piece 80 a control connector X is formed. In this exemplary embodiment, the threaded bolt 60 is configured with a guide bore 82 which is penetrated by a small piston 84, on which the control spring 58 is supported. A radially widened end section 86 of the small piston 84 is loaded by the control pressure at the control connector X. A locking washer 88 which stipulates a basic position of the small piston 84 is arranged at the other end section of the small piston 84. In the case, in which there is no control pressure or only a very low control pressure at the control connector X, the small piston 84 is displaced to the left out of the illustration according to FIG. 3 by way of the force of the control spring 58 until the locking washer 88 bears against the end face of the threaded bolt 60; the control spring 58 is then correspondingly prestressed. If the small piston 84 is loaded with control oil, it is adjusted into its position which is shown in FIG. 3, the control oil pressure being so great that it loads the control spring 58 with a higher prestress. This increase in the prestress leads to a displacement of the hyperbola which is indicated in FIG. 2 (see dashed line) or, more accurately, to a shift of the characteristic curve sections which are defined by the straight lines "1" and "2". That is to say, the characteristic curve can be shifted in the arrow direction by way of an increase in the prestress.

Figure 4:
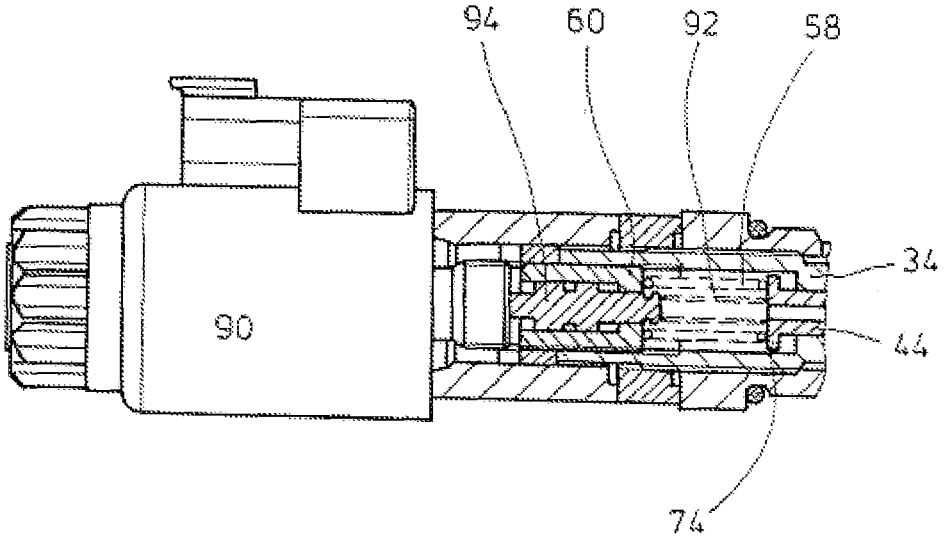
FIG. 4 shows a third exemplary embodiment of an adjusting device.

FIG. 4 shows a variant, in which the increase in the prestress does not take place hydraulically, but rather electrically by means of a switching magnet 90. If a switching magnet were then used instead of the control oil loading in FIG. 3, said magnet would have to be so powerful that it has to overcome the relatively high prestress of the control spring 58; accordingly, a component which was more expensive and also more voluminous would be required. FIG. 4 shows a variant, in which the shift of the hyperbola takes place by way of an increase in the prestress of an actuating spring 92 which is arranged coaxially with respect to the control spring 58 and likewise acts on the radially widened collar 74 of the control piston 44. As in the exemplary embodiment according to FIG. 2, the control spring 58 is supported on the threaded bolt 60 which is screwed into the sleeve 34. The prestress of the control spring 58 can therefore be set only by adjusting the threaded bolt 60. The actuating spring 92 is supported on a tappet 94 which for its part can be adjusted via the switching magnet 90. If the switching magnet 90 is deenergized, the actuating spring 92 is relieved or is loaded only with a comparatively low prestress which is added to that of the control spring 58. In order to shift the hyperbola, the switching magnet 90 is energized, with the result that the tappet 94 extends and increases the prestress of the actuating spring 92. The required magnetic force for adjustment is very low on account of the low spring rate and prestress of the actuating spring 92, but is sufficient to shift the hyperbola in the above-described way. Instead of the switching magnet 90, in principle a proportional magnet can also be used, with the result that a continuous shift of the characteristic curve is made possible.

The adjusting device according to the disclosure can also of course be used in hydraulic motors or other hydraulic units. The axial piston machines can be configured in a swash plate or oblique-axle design.

An adjusting device and an axial piston machine which is configured with an adjusting device of this type are disclosed. The adjusting device has an actuating piston which delimits an actuating space which can be connected to a control oil source or a control oil drain via a control valve. A control piston of the control valve is loaded firstly by a control spring and secondly by a spring arrangement which is also in active engagement with the actuating piston.

LIST OF REFERENCE NUMERALS

1 Axial piston pump
2 Housing
4 Driving mechanism
6 Cylinder barrel
8 Axial piston
10 Working space
11 Drive shaft
12 Control kidney
14 Control kidney
16 Sliding pad
18 Pivot cradle
20 Adjusting device
22 Articulation device
24 Control valve
26 Actuating piston
28 Valve bushing
30 Control oil flow path
32 Actuating space
34 Sleeve
36 Radial bore
38 Radial bore
40 Radial bore
42 Valve bore
44 Control piston
46 Radial step
48 Differential face
50 Control collar
52 Control groove
54 Control groove
56 Spring space
58 Control spring
60 Threaded bolt
62 Lock nut
64 Covering
66 Spring collar
68 Spring arrangement
70 Spring
72 Spring
74 Collar
76 Axial bore
78 Lock nut
80 Adapter piece
82 Guide bore
84 Small piston
86 End section
88 Locking washer
90 Switching magnet
92 Actuating spring
94 Tappet

What is claimed is:

1. An adjusting device for a hydraulic machine, comprising:

a control valve having a control piston configured to be adjusted out of a basic position counter to the force of at least one control spring;

an actuating piston delimiting an actuating space configured to be connected to a control oil source or a control oil drain via the control valve, the control piston of the control valve being configured with a differential face acted on directly by a system pressure of the control oil source and being arranged approximately coaxially with respect to the actuating piston; and a spring arrangement having at least one spring, the spring arrangement being configured to load the control piston in the opposite direction to the control spring, and to feed back a position of the actuating piston to the control piston as a feedback force, wherein the action of the system pressure on the differential face of the control piston generates a resultant pressure force on the control piston in the same direction as the load from the spring arrangement.

2. The adjusting device according to claim 1, wherein the control spring has a higher spring rate or higher prestress than the spring arrangement.

3. The adjusting device according to claim 1, wherein:

the spring arrangement includes at least two springs; and the at least two springs are arranged coaxially and supported on a head of the actuating piston of cup-shaped configuration.

4. The adjusting device according to claim 1, wherein the control spring is supported on a spring collar.

5. The adjusting device according to claim 1, wherein the prestress of the control spring is adjustable.

6. The adjusting device according to claim 1, wherein the control spring is assigned an actuating spring having an adjustable prestress, the actuating spring being arranged coaxially with respect to the control spring.

7. The adjusting device according to claim 6, wherein the actuating spring has a substantially lower spring rate or prestress than the control spring.

8. The adjusting device according to claim 6, wherein the adjustment of the prestress of the actuating spring takes place hydraulically or via a magnet.

9. The adjusting device according to claim 8, further comprising an actuating element (i) which is configured to be adjusted by a magnet or hydraulically, (ii) which penetrates a spring collar supporting the control spring, and (iii) on which the actuating spring is supported.

10. The adjusting device according to claim 1, further comprising: a valve bushing that defines an interior and a fluidic connection between the interior and each of the control oil source, the control oil drain, and the actuating space; and a sleeve that is disposed in the interior of the valve bushing so as to be axially adjustable, the sleeve defining an axial bore and a respective radial bore assigned to each fluidic connection of the valve bushing that is fluidically connected with the axial bore; wherein: the control piston is disposed in the axial bore so as to be axially displaceable; the spring arrangement is engaged with the control piston such that an axial position of the control piston sets a point of engagement for the spring arrangement; and axial adjustment of the sleeve displaces the control piston to adjust a point of engagement for a second spring of the spring arrangement.

11. An axial piston machine, comprising:

a pivot cradle prestressed into a basic position; and an adjusting device configured to adjust the pivot cradle, the adjusting device including:

a control valve having a control piston configured to be adjusted out of the basic position counter to the force of at least one control spring;

an actuating piston delimiting an actuating space configured to be connected to a control oil source or a control oil drain via the control valve, the control piston of the control valve being configured with a differential face acted on directly by a system pressure of the control oil source and being arranged approximately coaxially with respect to the actuating piston; and a spring arrangement having at least one spring, the spring arrangement being configured to load the control piston in the opposite direction to the control spring, and to feed back a position of the actuating piston to the control piston as a feedback force, wherein the action of the system pressure on the differential face of the control piston generates a resultant pressure force on the control piston in the same direction as the load from the spring arrangement.

12. The adjusting device according to claim 1, wherein:

the basic position corresponds to a maximum swept angle of the hydraulic machine;

connecting the actuating space to the control oil source causes the actuating piston to undergo a stroke out from the basic position;

the spring arrangement includes at least two springs; and the spring arrangement is supported on the actuating piston and is configured such that after a portion of the stroke of the actuating piston, one of the at least two springs of the spring arrangement passes out of active engagement with one or more of the control piston and the actuating piston.

13. The axial piston machine of claim 11, wherein:

the basic position corresponds to a maximum swept angle of the axial piston machine;

connecting the actuating space to the control oil source causes the actuating piston to undergo a stroke out from the basic position;

the spring arrangement includes at least two springs; and the spring arrangement is supported on the actuating piston and is configured such that after a portion of the stroke of the actuating piston, one of the at least two springs of the spring arrangement passes out of active engagement with one or more of the control piston and the actuating piston.

14. An adjusting device for a hydraulic machine, comprising:

a control valve having a control piston configured to be adjusted out of a basic position counter to the force of at least one control spring;

an actuating piston delimiting an actuating space configured to be connected to a control oil source or a control oil drain via the control valve, the control piston of the control valve being configured with a differential face acted on directly by a system pressure of the control oil source and being arranged approximately coaxially with respect to the actuating piston; and a spring arrangement having at least two springs, the spring arrangement being configured to load the control piston in the opposite direction to the control spring, wherein the spring arrangement is supported on the actuating piston and is configured in such a way that, in the case of a control oil connection of the actuating space to the control oil source, one of the springs of the spring arrangement passes out of active engagement with one or more of the control piston and the actuating piston after a part stroke of the actuating piston, and wherein the control spring is assigned an actuating spring having an adjustable prestress, the actuating spring being arranged coaxially with respect to the control spring.

15. The adjusting device according to claim 14, wherein the control spring has a higher spring rate or higher prestress than the spring arrangement.

16. The adjusting device according to claim 14, wherein:

the at least two springs are arranged coaxially and supported on a head of the actuating piston of cup-shaped configuration.

17. The adjusting device according to claim 14, wherein the control spring is supported on a spring collar.

18. The adjusting device according to claim 14, wherein the actuating spring has a substantially lower spring rate or prestress than the control spring.

19. The adjusting device according to claim 14, wherein the adjustment of the prestress of the actuating spring takes place hydraulically or via a magnet.

20. The adjusting device according to claim 14, further comprising:

a valve bushing that defines an interior and a fluidic connection between the interior and each of the control oil source, the control oil drain, and the actuating space; and a sleeve that is disposed in the interior of the valve bushing so as to be axially adjustable, the sleeve defining an axial bore and a respective radial bore assigned to each fluidic connection of the valve bushing that is fluidically connected with the axial bore;

wherein:

the control piston is disposed in the axial bore so as to be axially displaceable;

the spring arrangement is engaged with the control piston such that an axial position of the control piston sets a point of engagement for one of the at least two springs of the spring engagement; and axial adjustment of the sleeve displaces the control piston to adjust a point of engagement for another of the at least two springs of the spring arrangement.

* * * * *